United States Patent [19]

Hampton

[11] Patent Number: 4,531,465

[45] Date of Patent: Jul. 30, 1985

[54] METHOD AND APPARATUS FOR TUFTING MULTIPLE YARNS TO PRODUCE A DIFFERENTLY COLORED PATTERN

[76] Inventor: Willie E. Hampton, Rte. 5, Box 398, Chatsworth, Ga. 30705

[21] Appl. No.: 595,614

[22] Filed: Apr. 2, 1984

[51] Int. Cl.[3] ..... D05C 15/32

[52] U.S. Cl. ..... 112/79 A

[58] Field of Search ..... 112/79 R, 79 A, 266.2

[56] References Cited

U.S. PATENT DOCUMENTS 3,020,863 2/1962 Smith ..... 112/79 A

FOREIGN PATENT DOCUMENTS 921545 3/1963 United Kingdom ..... 112/79 A

*Primary Examiner*—Ronald Feldbaum

*Attorney, Agent, or Firm*—Patrick F. Henry

[57] ABSTRACT

At least two differently colored yarns are delivered by feed rollers through yarn guides under control by a single or double lobe cam between the yarns to a needle bar which carries the two ends per needle and inserts same through a primary backing fabric which is caused to zigzag to create a varigated or tweed-looking tufted pattern. The feed rollers and cam are controlled by separate variable sheaves. The method is characterized by the separation of two differently colored yarns to one needle and the control of the two yarns by a cam and sheave drive while moving the backing material laterally or transversely beneath the needles.

23 Claims, 11 Drawing Figures

METHOD AND APPARATUS FOR TUFTING MULTIPLE YARNS TO PRODUCE A DIFFERENTLY COLORED PATTERN

The field of this invention is tufted fabrics produced by inserting a needle through a backing fabric and particularly by the use of more than one yarn of different colors for the same needle and the control of same to produce the appearance of varigated or tweed-like pattern, resembling a space-dyed yarn pattern.

Tufted carpet has been produced with varigated or differently colored patterns through various procedures. For example, one well known procedure is the use of space-dyed yarns which have different colors along the same length of yarn so that after the carpet is produced on the tufting machine the resulting pattern will be varigated or perhaps a tweed effect. Another procedure for producing a pattern or appearance of different color is to dye the carpet after production or to imprint the carpet with a pattern produced by special rollers with pattern surfaces. U.S. Pat. No. 3,020,863 discloses a means for controlling the relative height of pile tufts in a cut pile tufted fabric by using two yarns to one needle but not for color effect. U.S. Pat. No. 3,356,048 discloses an apparatus for the production of tufted carpet in which two yarns are fed to one needle from opposite directions, one at constant feed length and the other at a variable, alternating feed length per needle together with a gripper means to catch intermittently the loops of yarns so that at each penetration of the needles, differing heights are formed which more or less overlap, so that different colorings appear alternately with different strength and special varigated color patterns. It is also known to utilize two lateral rolls of tufting needles and to zigzag by shifting the base material as disclosed in the U.S. Pat. No. 3,585,948 but not for color effect. It is also known that pattern effects are obtainable by utilizing at least two lateral rolls of tufting needles with the needles in one row staggered relative to the needles in the other roll by shogging or shifting rows of needles in the manner disclosed in U.S. Pat. No. 4,119,049. Further, U.S. Pat. No. 3,641,956 discloses the use of two yarns for the same needle with two loopers for each hollow needle for the purpose of eliminating directional corn row effect but not for a varigated effect. U.S. Pat. No. 2,990,792 discloses a carpet tufting apparatus having a double looper arrangement operatively associated with a single set of tufting needles. Two separate yarn ends are stitched to the fabric through a single eye or double eye in each needle in order to avoid disadvantages such as a shearing operation to produce cut tufts and the waste of yarn but not for the purpose of trying to produce a varigated effect from two or more yarns delivered in a controlled manner to one needle.

The present method comprises delivering at least two differently colored continuous but separate yarn members (black and white are considered colors) to the same needle bar which inserts the yarns through the primary backing fabric which is caused to zigzag (as for example by means of an oscillating roller having projections). One example of a way of controlling the yarn is to drive the infeed rollers and a double or single lobed cam between the yarns by means of variable sheaves and to maintain separation by a cam between the yarns.

Accordingly, one main object of this invention is to provice a varigated textile pattern by means of a needle tufting procedure employing at least two differently colored yarns to the same needle.

Another advantage of this invention resides in the simplicity of installation and operation whereby conventional tufting machines may be modified readily without prohibitive cost or expense to produce varigated carpet at a price below that of some existing methods, such as space dyed yarns.

Accordingly, it is possible to modify an existing carpet tufting machine to provide a single or doubled lobe cam roller.

Other and further objects and advantages of this invention will become apparent upon reading the following description of a preferred embodiment taken in conjunction with the accompanying drawings, in which.

DESCRIPTION OF A PREFERRED EMBODIMENT

Figure 1:
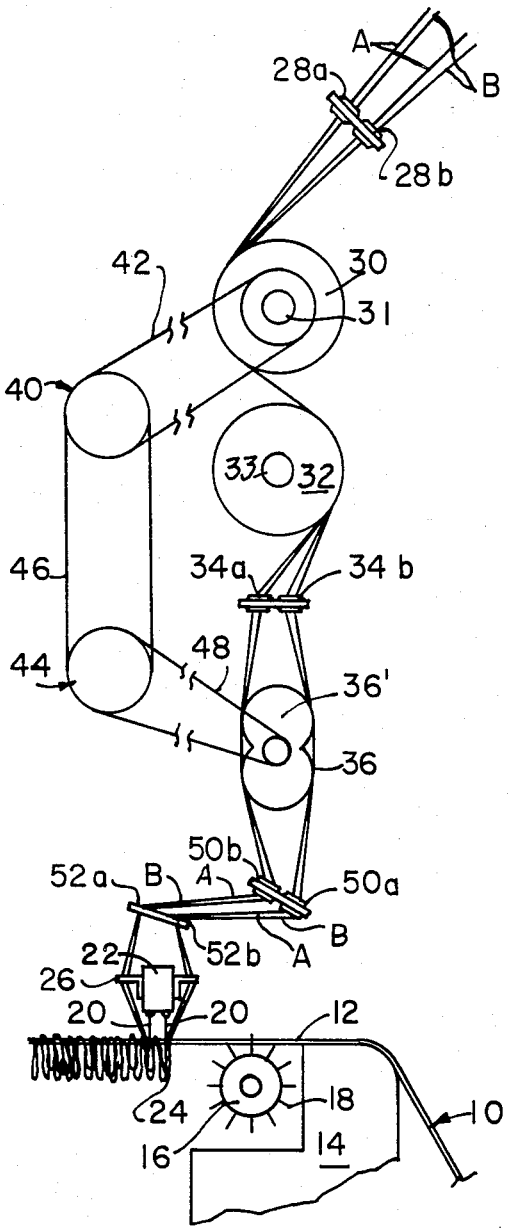
FIG. 1 is a diagrammatic side elevation view illustrating one form of the present apparatus on a conventional carpet tufting machine

As stated previously, carpet tufting machines have been in existence for more than thirty-five years and are discussed in the disclosures in the U.S. patents cited previously herein as well as the citations in those cited patents.

A conventional tufting machine 10 supports and moves a primary backing material or fabric 12 longitudinally across the machine frame 14. Fabric 12 is jogged, shifted or caused to zigzag by a shifting roller 16 mounted on a sliding shifting frame 17. Roller 16 has radially disposed sharp pins 18 protruding from the surface thereof and roller 16 is oscillated with slide frame 17 by means of a crank drive 19 driven by a motor (not shown) transversely of the frame 14 for the purpose of causing the backing material 12 to zigzag beneath needles 20 mounted on a needle bar 22 which extends transversely across frame 14 and being supported for upward or downward oscillation to cause needle 20 to penetrate the fabric 12 on on a forward stroke and to withdraw leaving the usual tufts 24 projecting from the fabric 12 in the usual manner of producing a tufted carpet. A double needle bar 22 has separate yarn guide 26, 27.

Separate and differently colored continuous carpet yarns A, B follow separate paths through spaced yarn guides **28*a* and 28*b* around the usual infeed-rollers 30 on shaft 31 and 32 on shaft 33, delivering the separate yarns A, B to another array of needle guides 34***a*, 34*b* and around a means for controlling and maintaining the separation of the yarns A, B comprising the present embodiment a double lobe cam roller 36 mounted on a central axial shaft 38 supporting the cam roller 36 for operation on the machine 10.

The infeed roller 30 is driven at a preselected feed by means of a variable sheave 40 and belt 42 and snychronized with another variable sheave 44 by means of a drive belt 46. Sheave 44 drives the double lobe cam roller 36 by means of a drive belt 48, thereby providing a preselected adjustable synchronization of rollers 30, 32 and the cam roller 36 whereby the travel of the respective yarns A, B is regulated so as to deliver each yarn A, B to the needle 20.

Figure 2:
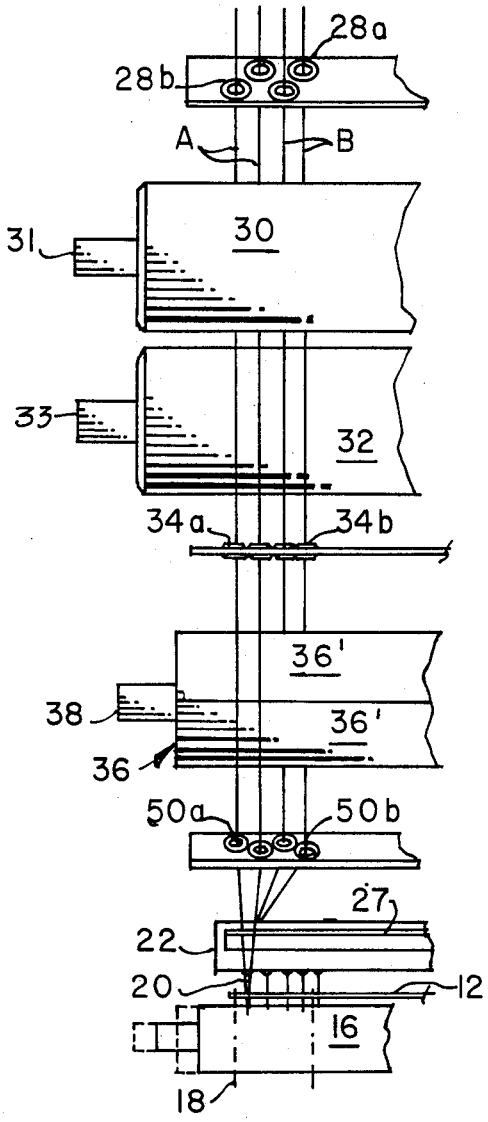
FIG. 2 is a front elevation view of the arrangement shown in FIG. 1.
Figure 3:
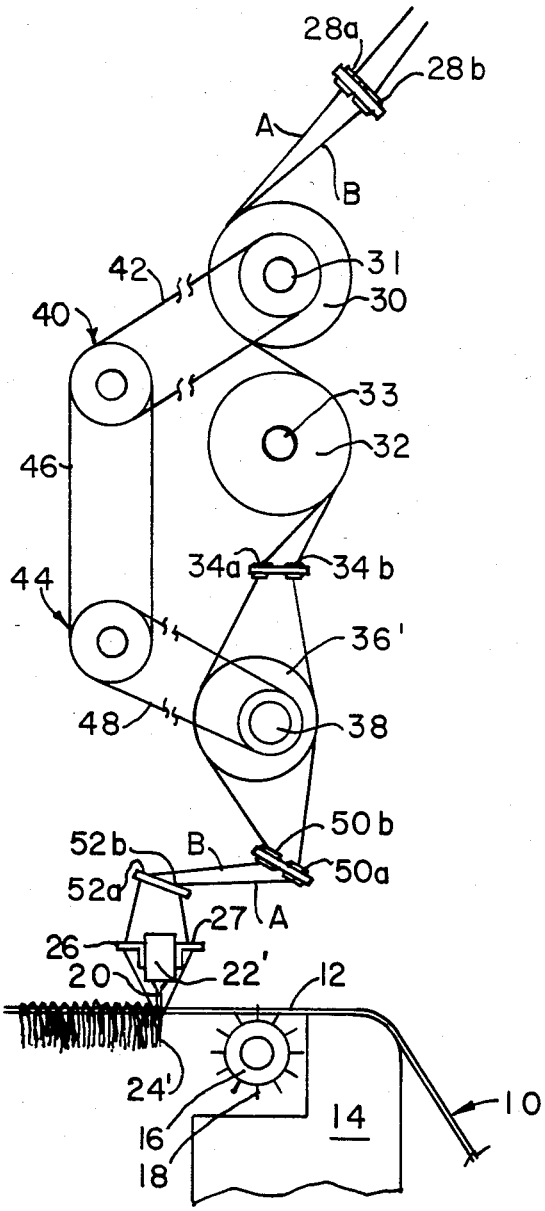
FIG. 3 is a diagrammatic side elevation view of a modification employing a single lobe cam for a straight needle bar receiving two yarns.
Figure 4:
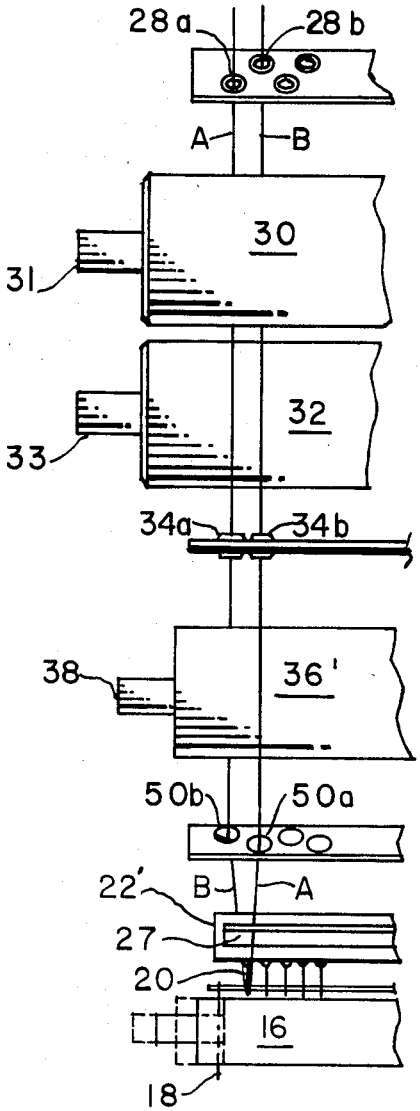
FIG. 4 is a front elevation view of the arrangement shown in FIG. 3.
Figure 5:
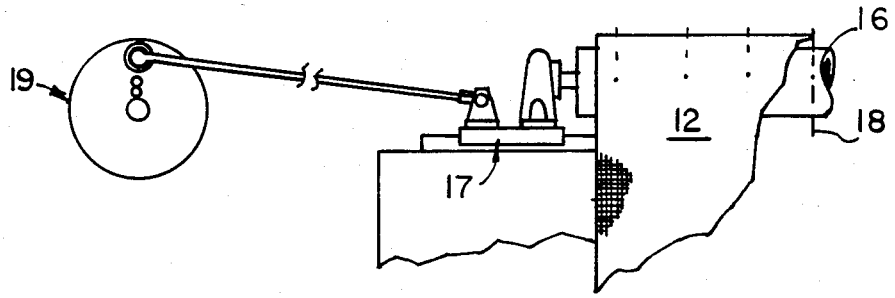
FIG. 5 is an elevation view showing part of the typical part of the typical zigzag mechanism on the machine of FIG. 1.

In a single needle version shown in FIGS. 3 and 4 to produce a tufted cut pile 24, one of the lobes 36' of the double lobe cam roller 36 may be eliminated completely thereby leaving a single lobe cam roller 36' which can be used with a single needle bar 22' having one row of needles 20 rather than two. Accordingly, the operation of the single lobe cam against the two yarns A, B would be in accordance with the movement of the single lobe against a respective yarn A, B in the manner shown in FIGS. 3, 4 and the operation is the same as the arrangement in FIGS. 1 and 2. Yarns A, B are guided through separate yarn guides 50*a*, 50*b* and thence through yarn guides 52*a*, 52*b* on the needle bar 22.

Figure 6:
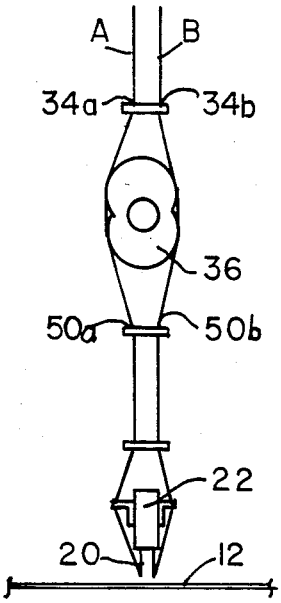
FIGS. 6–9 are a series of diagrams depicting the position of the needle carrier in relation to 90 degrees of rotation of the cam in FIGS. 1 or 3 based on 4 needle strokes per 360 degrees revolution of the cam in increments of $22\frac{1}{2}$ degrees.
Figure 7:
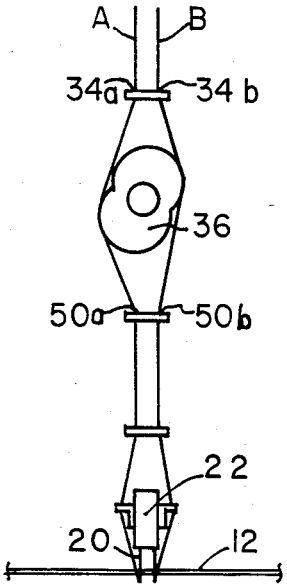
Figure 8:
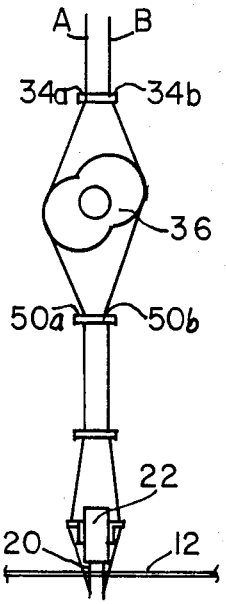
Figure 9:
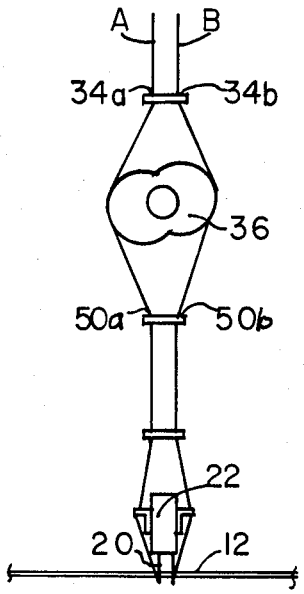
Figure 10:
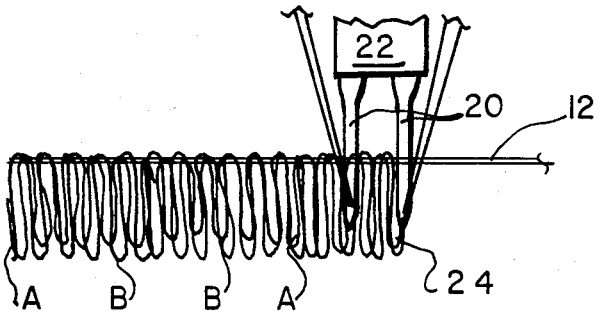
FIG. 10 is an enlarged view of the tufted carpet pile in FIG. 1.
Figure 11:
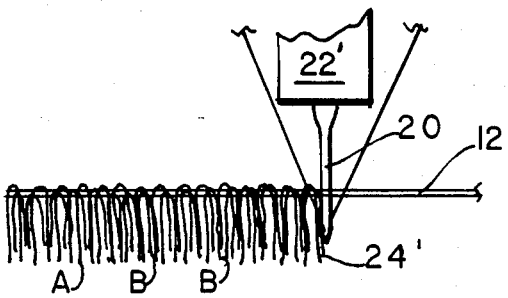
FIG. 11 is an enlarged view of the tufted carpet pile in FIG. 3.

The method and procedure employed in either the single cam 36 of FIGS. 3 and 4 or the double cam 36 of FIGS. 1 and 2 to provide a level pile 24 comprises directing different color yarns A and B separately to the needles 20 while alternatively tensing and relaxing or loosening respective yarns A and B by the cam lobe 36'. As the needles 20 descend in the manner starting as shown in FIG. 6, and thence in sequence in FIGS. 7 through 14, in increments of 27½ degrees of cam 36 movement, the cam 36 tenses and relaxes (or loosens) yarns A and B in a random but preselected, arbitrary timing sequence. This causes the stitch containing A and B to have A and B appear at different heights in the same stitch which creates a shaded appearance of the shorter end. The number of needle strokes per 360 degrees rotation of the cam 36 is selected arbitrarily to produce alternating appearances of yarn A or B as the longer or shorter yarn in the stitch. One row of stitches in this fashion takes on or gives a "spaced-dyed" yarn look and appearance while using only solid color yarn (black and white are colors) This effect can be achieved in standard loop construction pile or in cut pile construction with the use of standard loopers or cut pile looper attachments. The double cam 36 is used because of the distances between the needle rows in a staggered needle bar. A single lobe cam is used with a single needle 20 row bar 22'. The cut pile 24' in FIG. 3 is level but some yarn A is long, some yarn B is long, some yarn A is short and some yarn B is short. Likewise, in FIG. 1 the loop pile 24 is level but some yarn A is long loop, some yarn A is short loop, some yarn B is long loop and some yarn B is short loop; however, the effect appears to be all level loop pile of different colors.

While I have shown and described a particular embodiment of my invention together with a suggested mode of operation thereof and a method which may be practiced by the described embodiment this is by way of illustration only and does not constitute any limitation on the scope of this invention since there are various alterations, changes, deviations, eliminations and departures which may be made from the invention without departing from the scope of the invention as defined only by a proper interpretation of the appended claims.

The embodiments of the invention in which an exclusive property or privilege is claimed are defined as follows:

1. In a machine for producing a tufted fabric, having a varigated color appearance, comprising a machine frame on which is moved longitudinally a continuous primary backing material to receive and retain individual segments of differently colored yarn tufted therein by needles which penetrate said backing material:

feed means on said machine for continuously feeding and separately maintaining at least two separate yarns of different colors thereon for the purpose of tufting said yarns into said backing material to create a varigated appearance, guide means on said machine for maintaining said separately colored yarns in spaced relation until delivered at a respective needle, yarn control means for simultaneous operation between said yarns the separation of said differently colored yarns and to control same for variable delivery of separate yarn to a respective needle, said needles being mounted for oscillation on said machine to penetrate said backing fabric and each of said needles receiving respective differently colored yarns, and yarn drive means for driving said feed means for controlling said yarns and said yarn control means and drive means being synchronized with said feed means and said yarn control means to deliver yarn to said respective needles.

2. The device claimed in claim 1 wherein said yarn control means comprises yarn contact means continuously operable between yarns on said machines for varying the differently colored yarns fed to the needles.

3. The device claimed in claim 2 wherein said yarn contact means is a cam.

4. The device in claim 3 wherein said cam comprises a plurality of lobes and a support means for operating said roller between said yarns.

5. The device claimed in claim 1 wherein said needles are mounted on a needle bar and there is a yarn guide means thereon for maintaining said yarns separately until delivered to said needles.

6. The device claimed in claim 1 wherein each needle comprises a single needle opening to which both of said colored yarns are directed for simultaneous penetration into said backing material.

7. The device claimed in claim 1 wherein said backing material is shifted laterally as well as moved longitudinally.

8. The device in claim 1 wherein said feed means comprises feed rollers for feeding said yarns, and variable speed sheaves driving said yarn control means.

9. The device in claim 8 wherein said yarn control means comprises a cam means between said yarns.

10. The device in claim 9 wherein said cam has at least two lobes.

11. In a machine for producing a tufted fabric having a multicolored appearance, comprising a machine frame on which is moved longitudinally a continuous primary backing material to receive and retain individual segments of yarn tufted therein through said backing material:

two feed rollers on said machine for continuously feeding and separately maintaining at least two separate yarns of different colors thereon for the purpose of tufting said yarns into said backing material to create a varigated appearance, guide means on said machine for maintaining said separately colored yarns in spaced relation until delivered at a single needle, continuously operating cam means for simultaneous operation between said differently colored yarns to maintain the separation of said two differently colored yarns and to control same for variable delivery of separately colored yarns to the needles, needles mounted on said machine frame for oscillation on said machine to penetrate said backing fabric and said needles receiving said two differently colored yarns, and two variable sheaves for said feed rollers and for said cam means for controlling said yarns and one of said sheaves driving said first roller and said second sheave for synchronizing said two feed rollers, and said second sheave driving said cam means for delivery of separately colored yarns to said single needle.

12. The device claimed in claim 1 wherein said cam means comprises a cam roller on said machine mounted between said differently colored yarns.

13. The device claimed in claim 12 wherein said cam roller comprises double lobes and a support means for operating said cam roller between said yarns.

14. The device claimed in claim 11 wherein said needles are mounted on a needle bar and there is a yarn guide means thereon for maintaining a yarns separately until delivered to said needle.

15. The device claimed in claim 1 wherein each needle comprises a single needle opening to which both of said yarns are directed for simultaneous penetration into said backing material.

16. In a method for creating a varigated pattern on a longitudinally movable, primary backing material by means of a needle tufting operation in which a needle is caused to penetrate said backing material from one side to another and to withdraw in succession, the procedure comprising:

delivering and controlling in simultaneous and synchronized travel at least two differently colored yarns to a single needle, maintaining said yarns in separate travel and guiding said yarns to a single opening in said needle for simultaneous insertion through said backing material, and supplying different lengths of said yarns to said needle to create the appearance of a level pile in which there are some yarn members longer than others.

17. The method claimed in claim 16 including maintaining said differently colored yarns in separate relation during travel, continuously separating said yarns by a means traveling therebetween, and causing the synchronization of the travel of said yarns to said single needle by controlling said feed of said yarns and the distance therebetween.

18. The method claimed in claim 16 including continuously separating said yarns by means of a continuously moving cam located between said yarn during the travel thereof.

19. The method claimed in claim 16 including controlling the feed of said yarns by a yarn control means which is connected to and synchronized with a means for controlling the distance between the yarns.

20. The method as claimed in claim 17 wherein the means for controlling the a distance between the yarns during continuous travel thereof is a cam roller having at least one lobe thereon.

21. The method claimed in claim 17 wherein the means for controlling the feed is a variable sheave and the means for controlling the yarn control means is another second variable sheave and said sheaves are operatively associated with one another.

22. The method claimed in claim 16 including shifting said backing material laterally as well as longitudinally.

23. A carpet tufted by the method in claim 16, wherein there is an appearance of a varigated, level pile and said pile comprises long and short yarn members of each of the colors of yarn.

* * * * *